US007287378B2

(12) United States Patent
Chen et al.

(10) Patent No.: US 7,287,378 B2
(45) Date of Patent: Oct. 30, 2007

(54) DIVIDED EXHAUST MANIFOLD SYSTEM AND METHOD

(75) Inventors: Kai Chen, Villa Park, IL (US); Scott R. Peterson, Addison, IL (US); Ning Lei, Oak Brook, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 648 days.

(21) Appl. No.: 10/277,004

(22) Filed: Oct. 21, 2002

(65) Prior Publication Data

US 2004/0074480 A1 Apr. 22, 2004

(51) Int. Cl.
*F02M 25/07* (2006.01)

(52) U.S. Cl. ..... 60/605.2; 123/568.12; 123/568.2

(58) Field of Classification Search ..... 60/605.1, 60/605.2; 123/568.11, 568.12, 568.14, 568.16
See application file for complete search history.

(56) References Cited

U.S. PATENT DOCUMENTS 4,179,892 A 12/1979 Heydrich
4,249,374 A * 2/1981 Sugasawa et al. ..... 60/276
4,345,571 A * 8/1982 Iizuka et al. ..... 123/568.27
5,203,311 A * 4/1993 Hitomi et al. ..... 60/605.2
5,937,834 A 8/1999 Oto
6,324,847 B1 12/2001 Pierpont
6,408,833 B1 * 6/2002 Faletti ..... 123/568.17
6,470,864 B2 * 10/2002 Kim et al. ..... 123/568.12
6,598,396 B2 * 7/2003 Bailey ..... 60/605.2
6,694,735 B2 * 2/2004 Sumser et al. ..... 60/605.2

FOREIGN PATENT DOCUMENTS

DE 10152803 A1 * 10/2001

* cited by examiner

*Primary Examiner*—Hoang Nguyen
(74) *Attorney, Agent, or Firm*—Jeffrey P. Calfa; Gerald W. Askew

(57) ABSTRACT

A flow including air and exhaust gas is received at a boost pressure at a plurality of cylinders (103). Exhaust gas is expelled from a first subset of the plurality of cylinders (103) into a first divided exhaust manifold (103). Exhaust gas is expelled from a second subset of the plurality of cylinders into a second divided exhaust manifold (111). The first subset and the second subset are different. An exhaust gas recirculation (EGR) system receives at an EGR inlet (131 or 201 and 211) a part of the exhaust gas from the first divided exhaust manifold (109) and a part of the exhaust gas from the second divided exhaust manifold (111).

11 Claims, 4 Drawing Sheets

DIVIDED EXHAUST MANIFOLD SYSTEM AND METHOD

FIELD OF THE INVENTION

This invention relates to internal combustion engines, including but not limited to exhaust system interface to the exhaust gas recirculation (EGR) systems in internal combustion engines.

BACKGROUND OF THE INVENTION

Internal combustion engines are known to include exhaust gas recirculation (EGR) systems to reduce NOx (nitrous oxide) emissions. Air enters the engine through a turbocharger through a compressor, which pressurizes the air. The pressurized air flows to an intake manifold and enters the cylinders of the engine. The compressor is coupled to a turbine, which is driven by exhaust gas from the cylinders. The exhaust gas from the cylinders enters an exhaust manifold and flows into the turbine. The exhaust gas exits the turbine and is vented to the atmosphere. A fraction of the exhaust gas is diverted from entering the turbine and routed back to the intake manifold. The resultant air charge to the cylinder contains both fresh air and combusted exhaust gas.

It is desirable in the industry to improve EGR flow rate to reduce engine emissions while maintaining reasonable fuel economy performance. In order to achieve the desired exhaust gas flow through the EGR system and into the intake manifold, the pressure in the exhaust manifold must be higher than the (boost) pressure in the intake manifold. At times, the average boost pressure at the intake manifold is close to or higher than the back pressure, making flow through the EGR system negligible or non-existent during these times. Further, when the boost pressure is higher than the exhaust pressure, backflow from the intake manifold to the exhaust system results when the EGR valve is open.

A common approach to increasing pressure differential between the exhaust system and the intake system is to rematch the turbocharger. With a good match of the turbocharger, the exhaust manifold pressure may be higher than the intake manifold pressure. Nevertheless, matching techniques do not provide desired EGR mass flow under all engine conditions. Too much back pressure may negatively impact engine fuel economy.

Accordingly, there is a need for a method and apparatus that provides improved EGR mass flow rate to the intake manifold.

SUMMARY OF THE INVENTION

An apparatus comprises a first divided exhaust manifold in fluid flow communication with a first exhaust gas recirculation (EGR) path and a second divided exhaust manifold in fluid flow communication with a second EGR path. At least one check valve is arranged and constructed to prevent backflow from entering at least one of the first divided exhaust manifold and the second divided exhaust manifold.

DESCRIPTION OF A PREFERRED EMBODIMENT

The following describes an apparatus for and method of utilizing divided exhaust manifolds with an EGR system to make use of exhaust pulse energy from all the cylinders of an internal combustion engine regardless of cylinder firing order. Exhaust from both divided exhaust manifolds is input to the EGR system, thereby increasing mass flow through the EGR system. Check valves are located to prevent backflow from entering the divided exhaust manifolds, further increasing mass flow through the EGR system.

Figure 1:
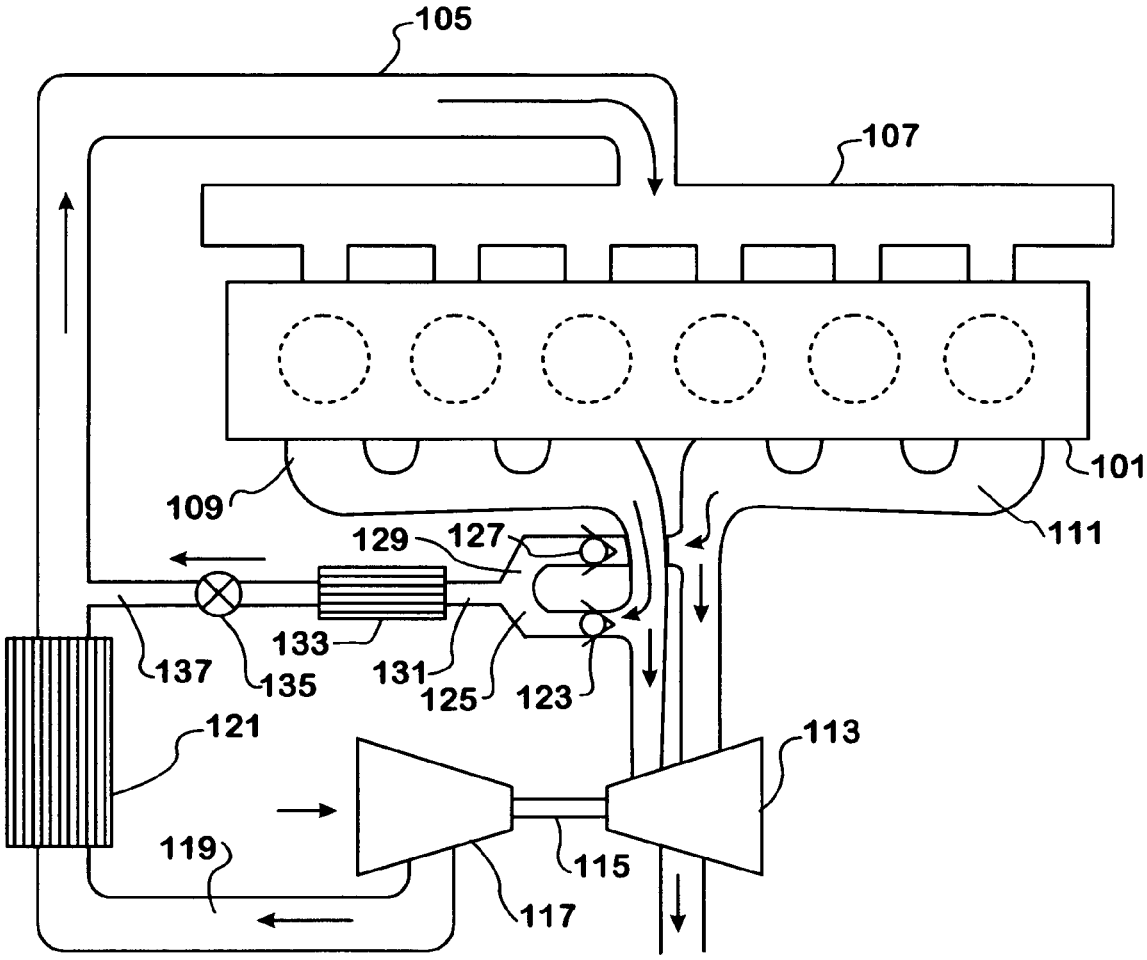
FIG. 1 is a diagram of engine having divided exhaust manifolds and check valves in accordance with the invention.

A diagram of an engine having an EGR system, divided exhaust manifold, and check valves is shown in FIG. 1. An engine block 101 having a plurality of cylinders 103 disposed therein receives mixed air and recirculated exhaust from an intake pipe 105 via an air intake manifold 107. Exhaust gas from the cylinders enters an exhaust manifold that comprises a first divided exhaust manifold 109 and a second divided exhaust manifold 111.

The divided exhaust manifolds 109 and 111 are independent from one another in that their outputs are not directly connected. The divided exhaust manifolds 109 and 111, however, may be cast as a single integral part although the flow paths for each manifold are independent of each other. In the example shown, exhaust from the left three cylinders 103 enters the first divided exhaust manifold 109, and exhaust from the right three cylinders 103 enters the second divided exhaust manifold 111. Other combinations of distributing the exhaust gas from cylinders among the exhaust manifolds are possible. The present invention is applicable to engines having two or more cylinders. In the event an odd number of cylinders is present, one of the divided exhaust manifolds typically receives one more cylinder's exhaust output flow than the other.

Part of the exhaust from each of the divided exhaust manifolds 109 and 111 enters the turbine 113, which has a divided turbo housing to receive flow from the divided exhaust manifolds. The turbine 113 is connected via a shaft 115 to a compressor 117 that outputs compressed air via a compressor discharge pipe 119 to an intercooler 121, as known in the art. The turbine 113, shaft 115, and compressor 117 form a turbocharger. The intercooler 121 output flow and the EGR output flow from an EGR outlet 137 are combined into the intake pipe 105. Although the present invention is shown with an example utilizing a turbocharger, the present invention may also be successfully applied to engines that are not turbocharged.

The other part of the exhaust from each of the divided exhaust manifolds 109 and 111 enters the EGR system. By providing exhaust from both divided exhaust manifolds 109 and 111 into the EGR system, exhaust gas energy is doubled from systems that provide exhaust gas to the EGR system from only one divided exhaust manifold. Exhaust from the first divided exhaust manifold 109 enters the EGR system through a first check valve 123 and into a first leg 125 of a Y-pipe. Exhaust from the second divided exhaust manifold 111 enters the EGR system through a second check valve 127 and into a second leg 129 of the Y-pipe.

The check valves 123 and 127 prevent backflow from the intake pipe 105 from entering the divided exhaust manifolds 109 and 111. Backflow is flow that occurs in a direction opposite to the intended EGR flow direction, e.g., backflow is flow from the intake pipe 105 and/or intake manifold 107 back through the EGR system and into the exhaust manifolds. For example, the first check valve 123 prevents flow from the intake pipe 105 and/or intake manifold 107 from entering the first divided exhaust manifold 109. The first check valve 123 also prevents flow from the second divided exhaust manifold 111 from entering the first divided exhaust manifold 109. The second check valve 127 prevents flow from the intake pipe 105 and/or intake manifold 107 from entering the second divided exhaust manifold 111. The second check valve 127 also prevents flow from the first divided exhaust manifold 109 from entering the second divided exhaust manifold 111. The combined flow from the first leg 125 and second leg 129 of the Y-pipe, i.e., the combined exhaust from both manifolds 109 and 111, enters a third leg 131 of the Y-pipe that forms an EGR inlet 131 and flows into the EGR cooler 133. The EGR cooler 133 cools the exhaust gas, which is output via the EGR valve 135 to the EGR outlet 137.

Figure 2:
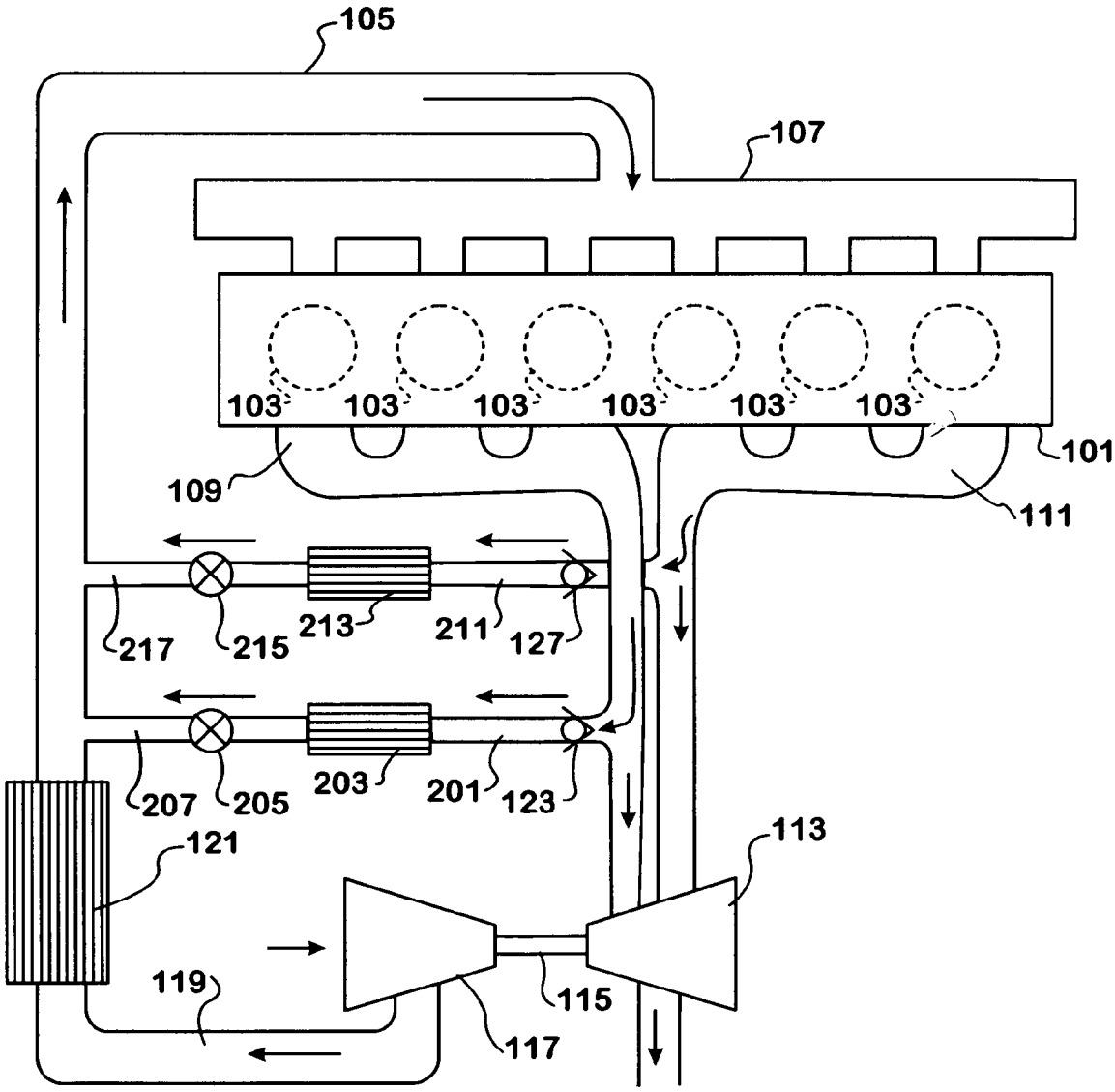
FIG. 2 is a diagram of an engine having divided exhaust manifolds, dual EGR circuits, and dual check valves in accordance with the invention.

A diagram of an engine having divided exhaust manifold, dual EGR circuits, and dual check valves is shown in FIG. 2. The components of FIG. 2 are the same as those in FIG. 1 and perform the same functions except that the EGR system comprises dual EGR circuits. An EGR circuit or path typically comprises one or more pipes to direct exhaust flow and one or more EGR valves. An EGR circuit or path may optionally include an EGR cooler, a filter, and/or other components. Dual EGR circuits may be utilized, for example, when a single EGR cooler is not sufficient to cool the exhaust gas from the two divided exhaust manifolds 109 and 111, for example, when the EGR flow is increased significantly. Dual EGR circuits, for example, increase the EGR coolers' overall effectiveness. The EGR system of FIG. 2 may be two separate and independently controlled EGR circuits. Alternatively, the EGR circuits of FIG. 2 may be controlled by the same source.

Exhaust from the first divided exhaust manifold 109 enters the first EGR circuit through the first check valve 123 and flows through a first EGR inlet 201 into a first EGR cooler 203. The first check valve 123 prevents air from the intake pipe 105 and/or intake manifold 107 from backflowing into the first divided exhaust manifold 109. The first EGR cooler 203 outputs cooled exhaust gas through a first EGR valve 205, into a first EGR outlet 207, and into the intake pipe 105.

Exhaust from the second divided exhaust manifold 109 enters the EGR system through the second check valve 127 and flows through a second EGR inlet 211 into a second EGR cooler 213. The second check valve 127 prevents exhaust from the intake pipe 105 and/or intake manifold 107 from backflowing into the second divided exhaust manifold 111. The second EGR cooler 213 outputs cooled exhaust gas through a second EGR valve 215, into a second EGR outlet 217, and into the intake pipe 105. The first EGR inlet 201 and the second EGR inlet 211 provide an EGR inlet to the EGR system.

Figure 3:
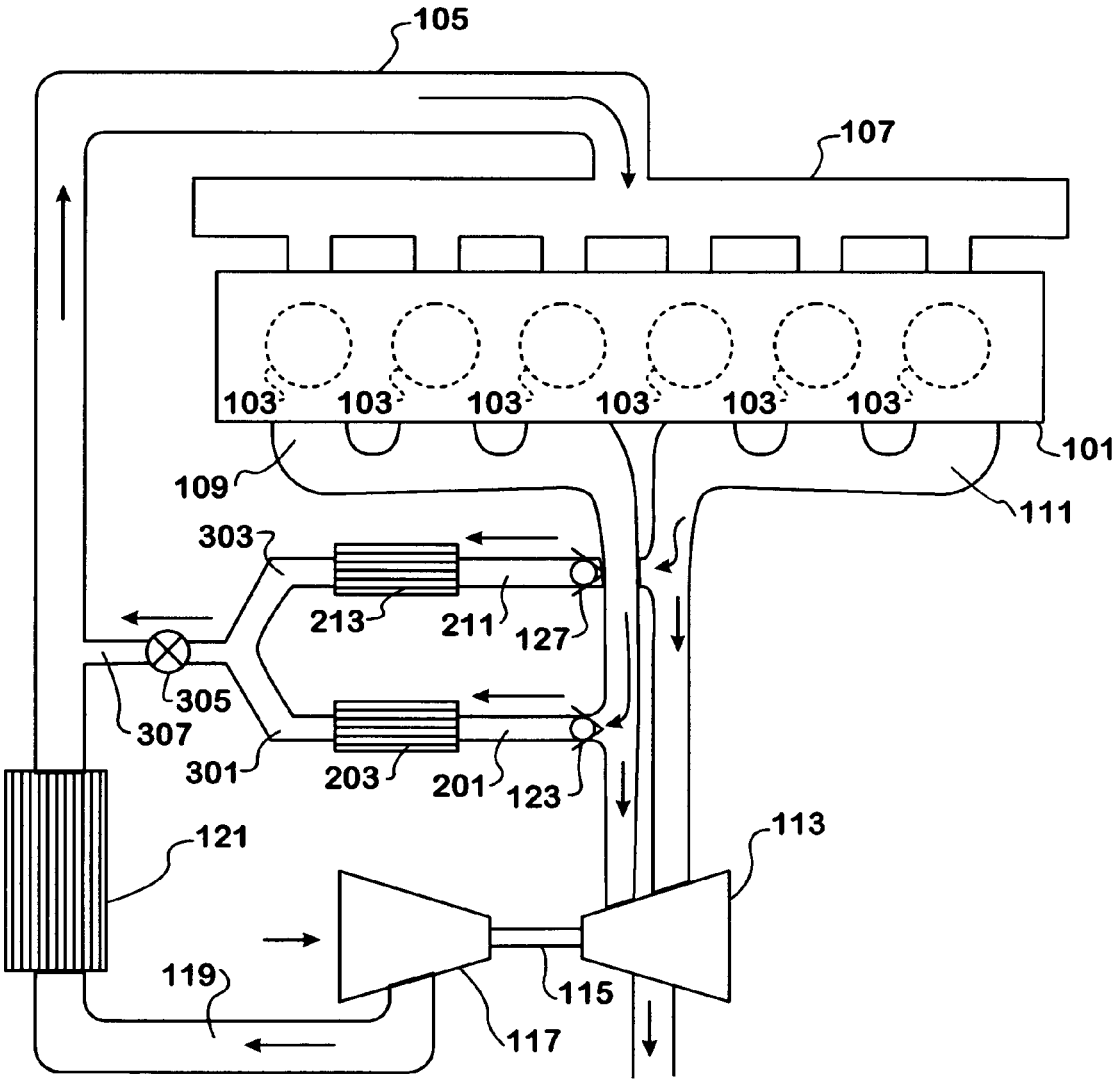
FIG. 3 is a diagram of an engine having divided exhaust manifolds, dual EGR coolers, dual check valves, and a single EGR valve in accordance with the invention.

A diagram of an engine having divided exhaust manifolds, dual EGR coolers, dual check valves, and a single EGR valve is shown in FIG. 3. This embodiment is similar to FIG. 2 in that it utilizes a separate exhaust flow path for each divided exhaust manifold 109 or 111 into its own EGR inlet 201 or 211 and EGR cooler 203 or 213, respectively., The output flow of the first EGR cooler 203 enters a first leg 301 of a Y-pipe, the output flow of the second EGR cooler 213 enters a second leg 303 of the Y-pipe, and the combined flow enters the third leg of the Y-pipe, where a single EGR valve 305 controls flow into a single EGR outlet 307 and into the intake pipe 105. This embodiment is advantageous because it does not require modification to the intake pipe 105, avoids the need for separate control of two EGR valves, and thus is cost effective.

To simplify EGR system control, the check valves 123 and 127 are preferably passive pressure controlled valves, such as reed valves. Although the check valves 123 and 127 are shown in a location between the divided exhaust manifold 109 or 111 and the EGR cooler(s) 133 (or 203 and 213), the check valves 123 and 127 may be placed in various locations in the EGR path. For example, in FIG. 1, a single check valve may be placed in the third leg 131 of the Y-pipe entering the EGR cooler 133, between the EGR cooler 133 and the EGR valve 135, or in the EGR outlet 137. In FIG. 2, for example, the check valves 123 and 127 may be placed between the EGR coolers 203 and 213 and the EGR valves 205 and 215, respectively, or in the EGR outlets 207 and 217, respectively. Example placements for the check valves 123 and 127 in FIG. 3 include in the first and second legs 301 and 303 of the Y-pipe and a single check valve placed in the third leg of the Y-pipe (before the EGR valve) or in the EGR outlet 307. The placement of the check valves 123 and 127 shown in FIG. 1 has the advantage of preventing backflow between the divided exhaust manifolds 109 and 111 as well as preventing backflow from the EGR outlet 137. The use of exhaust pulse energy is optimized for most EGR flow to the engine cylinders 103 when the check valves 123 and 127 are located closest to the divided exhaust manifolds 109 and 111. In FIG. 3, for example, the check valves 123 and 127 are placed closer to the divided exhaust manifolds 109 and 111 than to the third leg of the Y-pipe in the EGR path. Nevertheless, the closer the check valves 123 and 127 are placed to the divided exhaust manifolds 109 and 111, e.g., closest to the outlets of the divided exhaust manifolds 109 and 111, the more efficiently exhaust pulse energy is utilized.

The drawings of FIG. 1, FIG. 2, and FIG. 3 show various geometries, shapes, widths, and lengths, that are not necessarily indicative of the actual geometries, shapes, widths, and lengths of the pipes and other elements, but are drawn as such for simplicity of the drawing and to illustrate the fluid flow communication between and through the elements. For example, the air intake pipe 105 and EGR outlets 137, 207 and 217, or 307 may be part of the intake manifold 107. The flow passages are designed to prevent unnecessary flow restriction, as known in the art.

Figure 4:
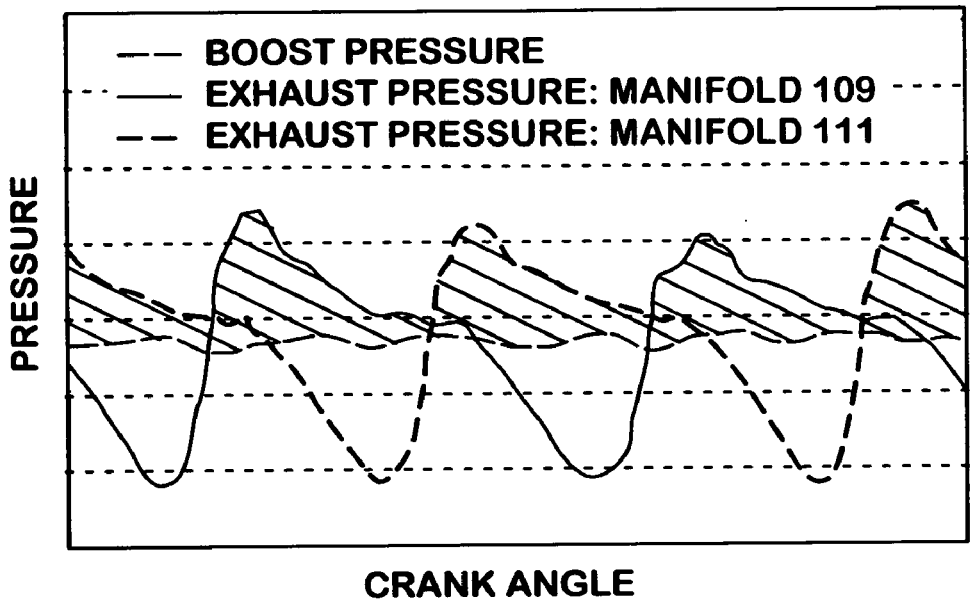
FIG. 4 is a diagram illustrating boost pressure and exhaust pressure versus crank angle in an internal combustion engine.

A diagram illustrating boost pressure and exhaust pressure versus crank angle in an internal combustion engine is shown in FIG. 4. As shown in FIG. 4, the boost pressure at the intake manifold 107 is a relatively fixed pressure with slight variances. The exhaust pressure at each manifold varies significantly. The pulse frequency, width, and amplitude of the exhaust pressure are dependent upon the engine firing order, exhaust valve lift profile, exhaust valve open/close timings, and engine operating conditions. Exhaust pressure is appreciably greater than the boost pressure after the cylinder fires and once the exhaust is expelled. The pressure continues to drop to a pressure appreciably less than the boost pressure due to the air intake cycle taking place. Pressures in an exhaust manifold vary throughout the combustion process, and because multiple cylinders output exhaust at various times into the exhaust manifold and receive air/exhaust mixture from the intake manifold at other times, the exhaust pulse energy may be lost, especially as more cylinders output exhaust into the same exhaust manifold. Dividing the exhaust from the cylinders into multiple exhaust manifolds helps to prevent loss of the exhaust pulse energy while more efficiently utilizing the exhaust pulse energy.

The check valves 123 and 127 may be, for example, one-way check valves that allow flow in only one direction through the valve, as are known in the industry. When the pressure from the EGR cooler side of the check valve 123 or 127 exceeds the pressure on the exhaust manifold side of the check valve 123 or 127, the check valve 123 or 127 closes, and does not permit backflow into the exhaust manifold 109 or 111. When the pressure from the exhaust manifold side of the check valve 123 or 127 exceeds the pressure on the EGR cooler side of the check valve 123 or 127, the check valve 123 or 127 opens, and permitting flow from the exhaust manifold 109 or 111 into the EGR cooler(s). The check valves 123 and 127 provide the ability to prevent backflow from one or more sources from entering the divided exhaust manifolds 109 and 111. Valves other than one-way check valves, including modified one-way check valves, may be utilized to prevent backflow as described herein.

By placing the check valves 123 and 127 as shown in FIG. 1, the check valves 123 and 127 prevent backflow from entering either divided manifold 109 or 111 from the other manifold 111 or 109. Thus, when pressure at one manifold 109 or 111 is significantly lower than the pressure at the other manifold 111 or 109, the use of check valves prevents backflow from occurring between the manifolds, thereby further increasing the use of the exhaust pulse energy.

The check valves 123 and 127 also prevent backflow from entering either divided manifold 109 or 111 from the intake pipe 105 and/or intake manifold. When pressure at one manifold 109 or 111 is significantly lower than the boost pressure, the use of check valves prevents backflow from the intake pipe 105 and/or intake manifold 107, thereby further increasing the use of the exhaust pulse energy.

This use of check valves optimally utilizes exhaust pulse energy that is highest when engine exhaust leaves a cylinder, thereby increasing EGR mass flow rate. By preventing backflow from entering the exhaust manifolds, the loss of overall exhaust pulse energy is prevented, thereby increasing desired EGR mass flow rate during the intake and exhaust gas exchange processes.

Figure 5:
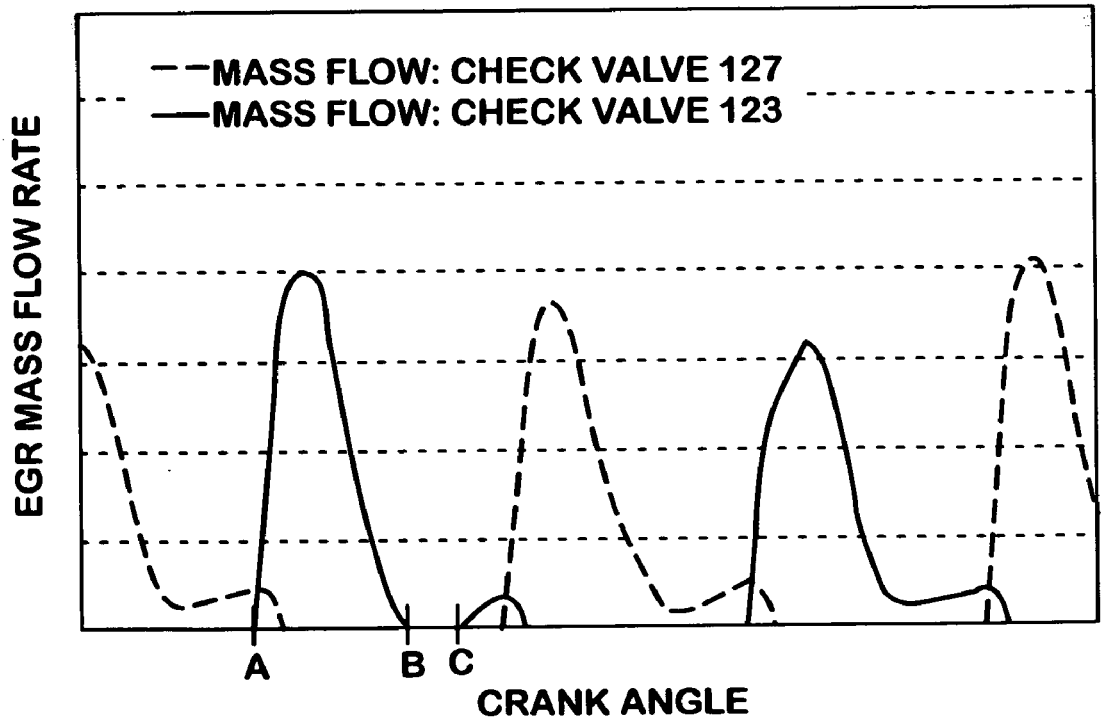
FIG. 5 is a diagram illustrating EGR mass flow rate versus crank angle in an internal combustion engine in accordance with the invention.

A diagram illustrating EGR mass flow rates through the check valves 123 and 127 versus crank angle in an internal combustion engine is shown in FIG. 5. When divided exhaust manifolds and one-way check valves are utilized, backflow does not enter the exhaust manifolds, loss of exhaust pulse energy is prevented, exhaust pulse energy is efficiently utilized, and EGR mass flow rates increase. The use of exhaust pulse energy as described herein results in increased EGR mass flow because of increased exhaust pressure to intake manifold pressure differential from point A to point B in FIG. 5. Further, from point B to C in FIG. 5, negative EGR mass flow is prevented by the check valve 123. Overall, negative EGR mass flow is prevented while increasing positive EGR mass flow. Improved EGR flow results in reduced NOx emissions from engines.

The present invention provides advantage over systems that utilize a check valve but not divided exhaust manifolds. Because the exhaust pressure pulse energy is partly lost and lower in undivided exhaust manifolds than with divided exhaust manifolds, the use of a check valve is not as effective because exhaust pressure does not exceed boost pressure as often or for as long of a period of time because exhaust pulse energy is lower. Undivided exhaust manifolds do not make effective use of the exhaust pulse energy in the exhaust system due to the dissipation of the exhaust pulse waves inside undivided exhaust manifolds. Loss of exhaust pulse energy is prevented, and exhaust pulse energy is better utilized to increase the desired EGR flow rate when divided exhaust manifolds are utilized. The present invention optimizes use of exhaust pulse energy from all divided exhaust manifolds, resulting in increased EGR flow. When divided exhaust manifolds and one-way check valves are utilized, the use of the exhaust pulse energy is further optimized, and backflow from the intake pipe and/or intake manifold is prevented.

The present invention provides advantage over systems that utilize divided exhaust manifolds but not a check valve(s). These systems typically recirculate exhaust gas from only one of the divided exhaust manifolds, and thus are unable to take advantage of exhaust pulse energy from all of the cylinders, typically reducing the available exhaust pulse energy by half. Thus, by recirculating exhaust gas from both divided exhaust manifolds, loss of exhaust pulse energy is prevented and exhaust pulse energy is utilized to increase EGR mass flow with the present invention, even when a check valve is not utilized.

The present invention may be applied to three or more divided exhaust manifolds, up to one exhaust manifold for each cylinder. The Y-pipe is modified to have an input from each divided exhaust manifold and a check valve is placed on each path from a divided exhaust manifold into the modified Y-pipe. One or more EGR systems are utilized, up to the number of divided exhaust manifolds.

Although the present invention is illustrated by the example of a six-cylinder engine, the present invention may be applied to: engines having two or more cylinders, including those with less than or greater than six cylinders; various engine types, such as I-6, V-6, V-8, and so forth; engines having different cylinder firing orders; diesel engines, gasoline engines, or other types of engines; turbocharged and non-turbocharged engines; and engines of any size.

The present invention optimizes the use of exhaust pulse energy to increase EGR mass flow. The EGR flow into the cylinders is greatly improved even when the mean exhaust pressure is below or close to the mean boost pressure. Increased EGR mass flow results in reduced NOx emissions from internal combustion engines. By combining the use of divided exhaust manifolds, providing exhaust from each divided exhaust manifold to the EGR system, and utilizing check valves such as one-way check valves, a greater improvement in EGR mass flow is achieved than would have been achieved by applying each of these feature individually. EGR mass flow is improved for all engine operating conditions, including various engine speed and load conditions.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus comprising:

a first divided exhaust manifold in fluid flow communication with a first exhaust gas recirculation (EGR) path;

a second divided exhaust manifold in fluid flow communication with a second EGR path;

a first check valve, arranged and constructed to prevent backflow from an intake manifold and backflow from the second divided exhaust manifold from entering the first divided exhaust manifold;

a second check valve, arranged and constructed to prevent backflow from the intake manifold and backflow from the first divided exhaust manifold from entering the second divided exhaust manifold;

wherein a first EGR cooler is disposed in the first EGR path and a second EGR cooler is disposed in the second EGR path.

2. The apparatus of claim 1, wherein the first check valve is located near an outlet of the first divided exhaust manifold in the first EGR path.

3. The apparatus of claim 1, wherein the second check valve is located near an outlet of the second divided exhaust manifold in the second EGR path.

4. The apparatus of claim 1, wherein the first EGR path and the second EGR path merge into a merged EGR path, and wherein the apparatus further comprises a Y-pipe in fluid communication with the first divided exhaust manifold and the second divided exhaust manifold such that the V-pipe outputs combined flow from the first divided exhaust manifold and the second divided exhaust manifold into the merged EGR path.

5. The apparatus of claim 4, wherein the first check valve is disposed within a first leg of the Y-pipe and the second check valve is disposed within a second leg of the Y-pipe, wherein the first leg of the Y-pipe is connected to the first divided exhaust manifold, the second leg of the Y-pipe is connected to the second divided exhaust manifold.

6. The apparatus of claim 1, further comprising a Y-pipe in fluid communication with the first EGR cooler and the second EGR cooler such that the Y-pipe outputs combined flow from the first EGR cooler and the second EGR cooler into a single EGR valve.

7. The apparatus of claim 1, wherein the first divided exhaust manifold is in fluid communication with a turbocharger via a first path, wherein the second divided exhaust manifold is in fluid communication with the turbocharger via a second path, and wherein the first path is not in fluid communication with the second path.

8. A method comprising the steps of:

receiving, at a boost pressure, a flow comprising air and exhaust gas at a plurality of cylinders;

expelling exhaust gas from a first subset of the plurality of cylinders into a first divided exhaust manifold;

expelling exhaust gas from a second subset of the plurality of cylinders into a second divided exhaust manifold, wherein the first subset and the second subset are different;

receiving, by an exhaust gas recirculation (EGR) system at an EGR inlet, a part of the exhaust gas from the first divided exhaust manifold and a part of the exhaust gas from the second divided exhaust manifold;

when the boost pressure is higher than exhaust pressure at one or more of the first divided exhaust manifold and the second divided exhaust manifold, inhibiting all backflow from entering the first divided exhaust manifold and the second divided exhaust manifold.

9. The method of claim 8, further comprising the step of, when exhaust gas pressure inside the first divided exhaust manifold is less than the boost pressure, inhibiting flow in a direction from an intake manifold toward the first divided exhaust manifold and the second divided exhaust manifold.

10. The method of claim 8, further comprising the step of, when exhaust gas pressure inside the one of the divided exhaust manifolds is less than pressure inside the other of the divided exhaust manifolds, inhibiting flow between the first divided exhaust manifold and the second divided exhaust manifold.

11. The method of claim 8, further comprising the step of preventing backflow from entering the first divided exhaust manifold and the second divided exhaust manifold.

* * * * *